United States Patent [19]

Thünker et al.

[11] Patent Number: 5,024,432

[45] Date of Patent: Jun. 18, 1991

[54] SHEET TRANSFER DEVICE FOR A PRINTING MACHINE

[75] Inventors: Norbert Thünker, Hirschberg; Gerhard Pollich, Heidelberg; Heiner Luxem, Wilhelmsfeld, all of Fed. Rep. of Germany

[73] Assignee: Heidelberger Druckmaschinen AG, Heidelberg, Fed. Rep. of Germany

[21] Appl. No.: 417,706

[22] Filed: Oct. 4, 1989

[30] Foreign Application Priority Data

Oct. 4, 1988 [DE] Fed. Rep. of Germany ..... 3833645

[51] Int. Cl.[5] ..... B65H 5/12

[52] U.S. Cl. ..... 271/268; 271/85

[58] Field of Search ..... 271/268, 267, 84, 85, 271/14; 221/219; 294/93, 94, 95, 97, 103.1, 104, 106, 110.2, 116, 119.1; 101/232, 408, 409, 410

[56] References Cited

U.S. PATENT DOCUMENTS

| | | | |
|---|---|---|---|
| 1,298,485 | 3/1919 | Feldman | 271/14 |
| 1,764,104 | 6/1930 | Jacobson | 271/26 B |
| 2,933,040 | 4/1960 | Helmig . | |
| 3,877,694 | 4/1975 | Wirz | 271/14 |
| 4,457,231 | 7/1984 | Kawaguchi . | |

FOREIGN PATENT DOCUMENTS

| | | |
|---|---|---|
| 677130 | 6/1939 | Fed. Rep. of Germany . |
| 1611291 | 12/1970 | Fed. Rep. of Germany . |
| 2154612 | 5/1973 | Fed. Rep. of Germany . |
| 3536535 | 6/1986 | Fed. Rep. of Germany . |
| 923605 | 4/1963 | United Kingdom . |
| 1326290 | 8/1973 | United Kingdom . |

*Primary Examiner*—David H. Bollinger

*Attorney, Agent, or Firm*—Herbert L. Lerner; Laurence A. Greenberg

[57] ABSTRACT

A sheet transfer device for a printing machine for taking over sheets which have been aligned at front lays and for transferring the sheets to a sheet-guiding drum includes a pregripper device swivellable between a sheet takeover and a sheet transfer position. Gripper pads are carried by the pregripper device, and a gripper shaft is swivel-mounted in the pregripper device and carries gripper fingers which are associated with the gripper pads. Also provided are a device for connecting the gripper shaft and the gripper fingers so that swivelling movements of the gripper shaft are transmitted to the gripper fingers, and a swivel device for swivelling the gripper shaft about a longitudinal axis thereof. A cam segment has a control surface for controlling the swivel device, and is adjustable so that a gap, formed between the gripper fingers and the gripper pads in the takeover position of the pregripper device and existing until alignment of the sheet at the front lays is terminated, is settable in accordance with the thickness of the sheets. The gap is so defined that the gripper fingers form top lays for a respective leading sheet edge. A control shaft is provided for adjusting the cam segment, the control shaft extending parallel to generatrices of the control surfaces and being arranged so as to be adjustable parallel to itself.

4 Claims, 1 Drawing Sheet

SHEET TRANSFER DEVICE FOR A PRINTING MACHINE

Figure 1:
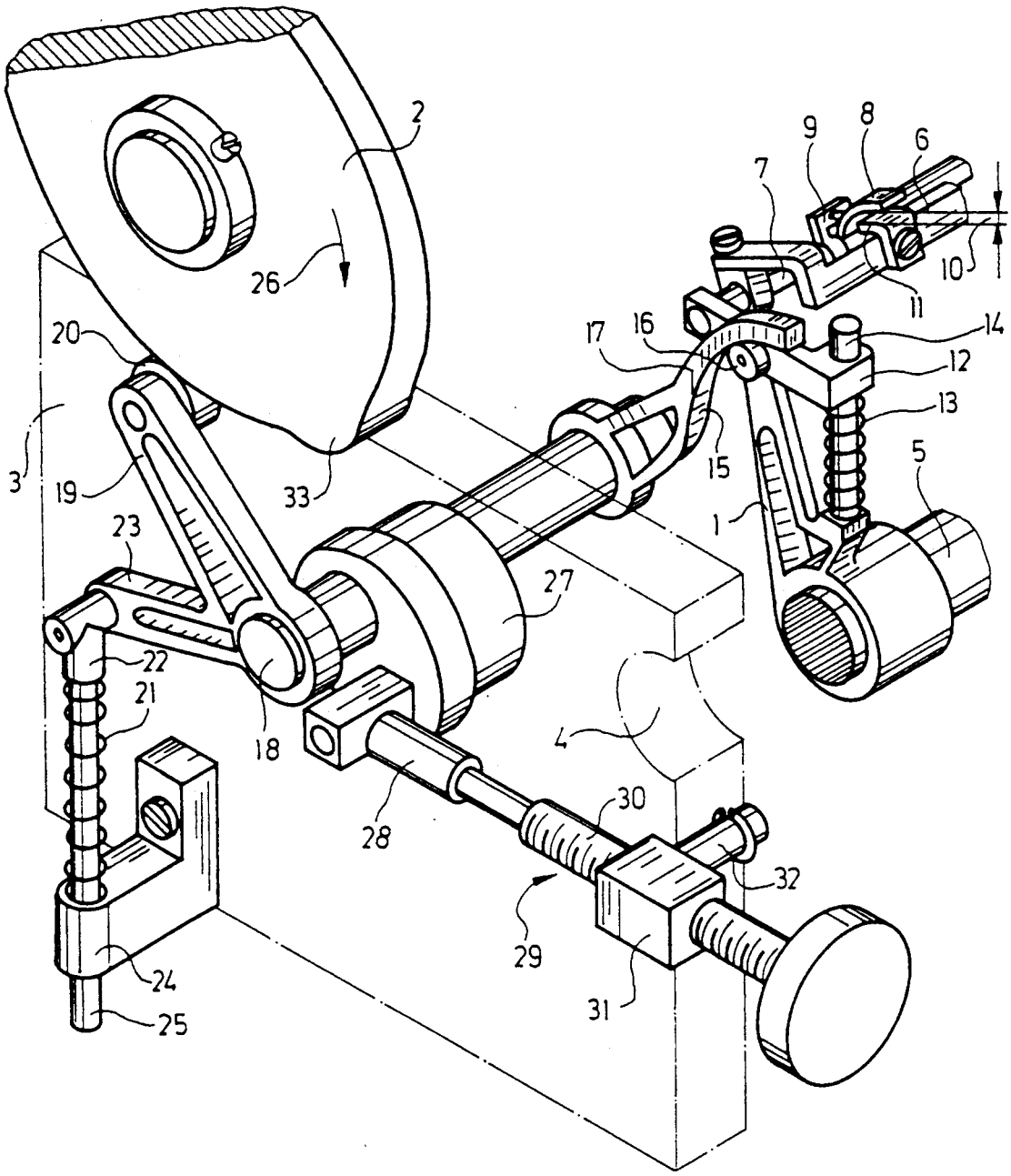

The invention relates to a sheet transfer device for a printing machine and, more particularly, to such a sheet transfer device for taking over sheets which have been aligned at front lays, and for transferring the sheets to a sheet-guiding drum including a pregripper device swivellable between a sheet takeover position and a sheet transfer position, gripper pads carried by the pregripper device, a gripper shaft articulatingly or swivel mounted in the pregripper device, and carrying gripper fingers associated with the gripper pads, means for connecting the gripper shaft and the gripper fingers so that swivelling movements of the gripper shaft are transmitted to the gripper fingers, a swivel device for swivelling the gripper shaft about its longitudinal axis, and a cam segment having a control surface for controlling the swivel device, the cam segment being adjustable so that a gap formed between the gripper fingers and the gripper pads in the takeover position of the pregripper device and existing until alignment of the sheet at the front lays is terminated is settable in accordance with the thickness of the sheets, the gap being so defined that the gripper fingers form top lays for a respective leading sheet edge.

Although German Published Non-Prosecuted Application (DE-OS) 16 11 291 is concerned with such a sheet transfer device, it does not offer any proposal for adjusting a respective cam segment.

German Published Non-Prosecuted Application (DE-OS) 35 36 535 discloses an adjustable cam segment for controlling a swivel device for reciprocatingly swivelling a gripper shaft, which is carried by a pregripper arm of a pregripper device, about the longitudinal axis of the gripper shaft. In this regard, the cam segment is swivellable about a stationary axis and forms a first rocker arm of a four-bar linkage, the second rocker arm of which carries a roller actuated by a rotating cam or cam disk. In each swivel position of the pregripper arm, the outlines or contours of the cam and the cam segment are responsible for or determine the respective position of the gripper finger with respect to the gripper pad associated therewith i.e. in each rotary position of the cam there exists a respective defined gap between gripper finger and gripper pad, the gap having a size ranging from zero to a maximum value. This would mean that a specific cam or cam disk would have to be provided for each sheet thickness, for example, if the gripper fingers were constructed as top lays, as suggested in the German Published Non-Prosecuted Application (DE-OS) 16 11 291. Another possibility of adjustment to the varying sheet thicknesses would be to construct the coupler of the four-bar linkage so that it is adjustable with respect to its length. As in the case of replacing the cam or cam disk, this possible construction, too, would require interfering with the mechanical structure inside the printing machine to which access is normally difficult, which would call for a considerable amount of makeready time.

Based upon this state of the art it is thus an object of the invention to provide a sheet transfer device of the foregoing general type which requires hardly any makeready time for adjusting to different sheet thicknesses.

With the foregoing and other objects in view, there is provided, in accordance with the invention, a sheet transfer device for a printing machine for taking over sheets which have been aligned at front lays and for transferring the sheets to a sheet-guiding drum, comprising a pregripper device swivellable between a sheet takeover and a sheet device; a gripper shaft swivel-mounted in the pregripper device and carrying gripper fingers associated with the gripper pads; means for connecting the gripper shaft and the gripper fingers so that swivelling movements of the gripper shaft are transmitted to the gripper fingers; a swivel device for swivelling the gripper shaft about a longitudinal axis thereof; a cam segment having a control surface for controlling the swivel device, the cam segment being adjustable so that a gap, formed between the gripper fingers and the gripper pads in the takeover position of the pregripper device and existing until alignment of the sheet at the front lays is terminated is settable in accordance with the thickness of the sheets, the gap being so defined that the gripper fingers form top lays for a respective leading sheet edge; and a control shaft for adjusting the cam segment, the control shaft extending parallel to generatrices of the control surfaces and being arranged so as to be adjustable parallel to itself.

A control shaft provided in accordance with the invention has the advantage that it can be located at a side wall of the printing machine so as to be accessible from the outside and is, accordingly, directly accessible for a parallel displacement with respect to itself.

Furthermore, this offers the possibility of adjusting the control shaft while a printing machine which is equipped with a sheet transfer device constructed in accordance with the invention is in operation so that, without interrupting the printing process, it is possible to effect adjustments e.g. when a gap formed between the gripper fingers functioning as top lays and the gripper pads of a pregripper device proves to be too small because, as a result of cutting, the leading edges of the sheets are formed with a burr resulting from the cutting or trimming which necessitates a widening of the gap.

In accordance with another feature of the invention, the control shaft is connected to the cam segment and to a roller lever so as to be fixed against rotation relative thereto, and including a roller carried by the roller lever; a cam in engagement with the roller; drive means for rotating the cam; an eccentric bushing rotatably mounted in a side wall of the printing machine and rotatably bearing the control shaft; and adjusting means for turning the eccentric bushing.

Accordingly, in contrast with the state of the art disclosed in the German Published Non-Prosecuted Application (DE-OS) 35 36 535 of a control device of a pregripper device, a by-no-means inconsiderable reduction in the construction is achieved by the possibility of mounting the roller lever and the swivellable cam segment in common instead of separately. In addition, mounting the control shaft in an eccentric bushing which is turnable by adjusting means offers an especially simple possibility of adjusting the control shaft parallel to itself by merely turning the eccentric bushing. This turning can be effected manually or by motor-operated adjusting means depending upon the desired extent of automation.

In accordance with a further feature of the invention, the eccentric bushing, in a middle position wherein the gap formed between the gripper fingers and the gripper pads in the takeover position of the pregripper device is adjusted to a medium sheet thickness, is oriented so that respective longitudinal axes of the control shaft, the eccentric bushing and the roller are disposed substantially in one plane.

In this regard, the eccentric bushing can be turned in opposite directions, starting from the middle position, for the purpose of being adjusted to varying sheet thicknesses, depending upon whether the gap adjusted to a medium sheet thickness should be made narrower or wider, the roller being in engagement with the cam or cam disk at a location which, in practice, corresponds to an instantaneous center of rotation during the turning of the eccentric bushing. In this connection there are no phase displacements which have any practical influence on the movements of the gripper fingers.

In accordance with an alternate and concomitant feature of the invention, the cam is arranged so as to be adjustable in phase position with respect to the drive means for rotating the cam.

Such an embodiment is advantageous when, as a result of the cam shaft adjustment, the otherwise occurring phase displacements are beyond a practically negligible range. Such a case could occur, for example, if sheets with greater varying thicknesses are to be transferred to a sheet-guiding drum by the very same sheet transfer device.

Because the subject matter of the invention of the instant application pertains to the adjustment of an aforedescribed sheet transfer device to different sheet ticknesses, the devices cooperating with the sheet transfer device such as transfer means for conveying the sheet to the front lays, the front lays themselves and the sheet-guiding drum are not illustrated in the drawing. Furthermore, the drawing is limited to parts of the sheet transfer device which are associated with one side of a printing machine, not excluding however an identical arrangement on both sides of the printing machine. In addition, the drawing does not include means for swivelling the pregripper device between the takeover position and the transfer position. Such prior art means are readily obtainable from German Patent 677,130, for example, and are able to be modified so that the pregripper device is disposed below a feed table.

Other features which are considered as characteristic for the invention are set forth in the appended claims.

Although the invention is illustrated and described herein as embodied in a sheet transfer device for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing in which the single FIGURE of the drawing is a perspective view of the device according to the invention.

Referring now to the FIGURE of the drawing, there is shown therein a pregripper arm 1 which can be swivelled between a takeover position and a transfer position and is in a phase location shortly before transfer of a sheet to a sheet-guiding drum, the latter being arranged concentrically to the axis of rotation of a cam 2 rotating in the direction of the curved arrow 26 shown in the drawing and constructed, for example, as a sheet feeding drum. A fragment of a side wall 3 of a printing machine is illustrated in phantom. A recess 4 is formed in the side wall 3 for receiving therein a pregripper shaft 5, which is swivelable about its longitudinal axis, only a fragmentary section of the pregripper shaft 5 being shown. The pregripper shaft 5 and the pregripper arm 1 are connected to one another so as to be fixed against rotation relative thereto. The aforementioned non-illustrated means for swivelling the pregripper device engage with the pregripper shaft 5. The end of the pregripper arm 1 facing away from the pregripper shaft 5 carries a gripper bridge 6 and a gripper shaft 7 which is rotatably mounted in the pregripper arm 1. Gripper fingers 8 are arranged so as to be rotatable about the gripper shaft 7 and braced resiliently against gripper entrainers or dogs 9 which, in turn, are connected to the gripper shaft 7 so as to be fixed against rotation relative thereto. Because such an arrangement has become known, for example, from U.S. Pat. No. 2,933,040, it is not necessary to provide a detailed description of the gripper arrangement formed of the gripper fingers 8 and gripper entrainers 9.

A gap 10 adjustable to or matchable with various sheet thicknesses in accordance with the invention is formed between the gripper fingers 8 and gripper pads 11 associated therewith, which are attached to the gripper bridge 6. In the illustrated position of the pregripper arm 1 (shortly before the sheet transfer to a sheet-guiding drum), the gap 10 is filled by the sheet to be transferred (in contrast with the illustrated view), and the sheet is clamped within the gap 10. In the interest of simplicity, the representation of a clamped sheet is dispensed with. Only one of the gripper arrangements provided along the gripper bridge 6 and of the gripper pads 11 associated therewith are illustrated in the drawing.

For reciprocatingly swivelling the gripper shaft 7 about its longitudinal axis there is provided a swivel device having a swivel lever 12 which is connected to the gripper shaft 7 so as to be fixed against rotation relative thereto. This swivel lever 12 is biased by a compression spring 13 to swivel in a first swivel direction (counterclockwise in the FIGURE). The spring 13 is braced against the pregripper arm 1, and is guided by a guide shaft 14 which freely extends through a bore formed in the swivel lever 12. Spaced at a distance from the location at which the swivel lever 12 is connected to the gripper shaft 7 so as to be fixed against rotation relative thereto, the swivel lever 12 carries a roller 16 engaging with a control surface 15 due to the biasing action of the compression spring 13, the roller 16 being in rolling contact with the control surface 15. The control surface 15 is formed by a cam segment 17 which is connected to a control shaft 18 so as to be fixed against rotation relative thereto. The control shaft 18 extends parallel to generatrices of the control surface 15 and is adjustable parallel to itself, as described hereinafter in greater detail.

By means of the cam segment 17, the swivel lever 12 is swivelled in a second swivel direction (clockwise in the FIGURE) i.e. opposite to the first swivel direction, if a respective clockwise swivelling of the control shaft 18 about its longitudinal axis takes place.

Swivelling of the control shaft 18 about its longitudinal axis in opposite swivel' directions is effected by means of a roller lever 19 which is also connected to the control shaft 18 so as to be fixed against rotation relative thereto. At the end thereof facing away from the rigid or fixed connection thereof with the control shaft 18, the roller lever 19 carries a roller 20 which is in rolling contact with the peripheral surface of the cam disk 2 and is biased thereagainst by another compression spring 21. In order to achieve a suitable bias or prestress, the compression spring 21 is clamped between a swivel head 22 on a lever arm 23 of the roller lever 19 and a support or counterbearing 24 attached to the side wall 3, and is guided by another guide shaft 25 extending freely through a bore formed in the support 24.

The cam segment 17 thus assumes a swivel position with respect to the longitudinal axis of the control shaft 18 which depends upon the respective rotary position of the cam 2, and the roller 16 describes a path depending upon the respective shape of the cam disk 2 and the control surface 15 during the swivelling of the pregripper arm 1.

This path then determines instantaneous angular positions of the gripper fingers 8 with respect to the gripper pads 11 and is thus responsible for the fact that, in the takeover position of the pregripper arm 1, a sheet can be slid in initially loosely between the gripper fingers 8 and the gripper pads 11, the sheet is then clamped between the gripper fingers 8 and the gripper pads 11 and remains clamped, during the swiveling of the pregripper arm 1 into the transfer position, until the transfer position has been reached, and that the gripper fingers 8 are lifted again from the sheet, after the sheet has been gripped by the gripper devices of a non-illustrated feeder drum, and enable the feeder drum to transport the sheet further. The size of the gap 10 which adjusts itself with respect to the loose sliding-in of the sheet in the takeover position of the pregripper arm is thereby determined.

According to the invention, this gap 10 is adjusted to different sheet thicknesses by arranging the control shaft 18 so that it is adjustable parallel to itself. This measure can be carried out especially so that the spatial position of the roller 20 is maintained with practically adequate accuracy. As a consequence of a parallel adjustment of the control shaft 18, the spatial location or position of the cam segment 17 and, thereby, of the control surface 15 is varied so that, when the pregripper arm 1 swivels reciprocatingly, the roller 16 is displaced along spaced-apart paths, depending upon the direction and extent of adjustment of the control shaft 18. Thus, with respect to the pregripper shaft 5, the spacings between the paths along which the roller 16 is displaced and, thereby, especially the size of the smallest possible gap 10 may be selected by the parallel adjustment of the control shaft 18.

The arrangement of the control shaft 18 which is adjustable parallel to itself is realized in the embodiment shown in the FIGURE of the drawing by means of an eccentric bushing 27 which is rotatably mounted in the side wall 3. The control shaft 18 is thereby rotatably mounted in a longitudinal bore formed in the eccentric bushing 27, the longitudinal bore being arranged eccentrically with respect to the eccentric bushing 27.

In the embodiment illustrated in the FIGURE of the drawing, manually actuatable adjusting means for rotating the eccentric bushing 27 are provided as follows.

To a front side of the eccentric bushing 27 located outside the side wall 3, there is articulatingly connected a further swivel head 28 in which an adjusting spindle 29 is mounted so as to be rotatable and non-displaceable axially. A threaded section 30 of the adjusting spindle 29 cooperates with a spindle nut 31 which is articulatingly connected by a bolt 32 to the side wall 3 so that the adjusting spindle 29 guided in the spindle nut 31 is swivellable in a plane extending parallel to the side wall 3.

The eccentric bushing 27 can thereby be adjusted like a crank of a bellcrank drive and thus also the control shaft 18 mounted in the eccentric bushing 27 is adjustable parallel to itself.

In the FIGURE of the drawing, the control shaft 18 is in a middle position in which the gap 10 is adjusted to a medium sheet thickness. In this middle position, the respective longitudinal axes of the control shaft 18, the eccentric bushing 27 and roller 20 are in one plane. The required extent of adjustment of the control shaft based upon this middle position beyond the aforementioned plane in order to adjust the gap 10 to the sheet thickness do not cause any phase displacement during the motion of the gripper fingers 8, if the sheet thicknesses do nor differ excessively.

As mentioned hereinbefore, the pregripper arm 1 illustrated in the FIGURE of the drawing is located shortly before the transfer position in which a sheet is transferred to the non-illustrated feeder drum. After the sheet has been taken over by the aforementioned non-illustrated gripper devices of the feeder drum, the gripper fingers 8 are swivelled temporarily far away from the gripper pads 11 in order to leave the path of the sheet which is conveyed further. This procedure is effected by the nose 33 of the cam 2, which is located slightly before the roller 20 in the position illustrated and as viewed in the direction of rotation of the cam 2 as represented by the curved arrow 26.

In the illustrated embodiment, the non-illustrated feeder drum serves as drive means by which the cam 2 is rotated, the cam 2 being so connected to the feeder drum as to be fixed against rotation relative thereto.

An embodiment in which, furthermore, the cam 2 is arranged so as to be adjustable with respect to the drive means of the cam 2 in the sense of an adjustment of the phase position of the cam 2 is not shown in the drawing, because appropriate constructive solutions are obtainable from the state of the art e.g. from U.S. Pat. No. 4,457,231. In the construction disclosed in this patent it would possibly be necessary or desirable to replace the ring gear for a cam which is provided with a correspondingly formed bearing bore.

The foregoing is a description corresponding in substance to German Application P 38 33 645.6, dated Oct. 4, 1988, the International priority of which is being claimed for the instant application, and which is hereby made part of this application. Any material discrepancies between the foregoing specification and the aforementioned corresponding German application are to be resolved in favor of the latter.

There is claimed:

1. Sheet transfer device for a printing machine for taking over sheets which have been aligned at front lays and for transferring the sheets to a sheet-guiding drum, comprising a pregripper device disposed across a sheet travel path at a location between front lays of a printing machine and a sheet-guiding drum of the printing machine and swivellable between a sheet takeover position wherein a sheet aligned at the front lays is taken over by said pregripper device and a sheet transfer position wherein the sheet is released by said pregripper device to a sheet-guiding drum;

gripper pads carried by said pregripper device across the sheet travel path;

a gripper shaft swivel-mounted in said pregripper device and carrying gripper fingers in juxtaposed relationship with said gripper pads;

means for connecting said gripper shaft and said gripper fingers so that swivelling movements of said gripper shaft are transmitted to said gripper fingers;

a swivel device for swivelling said gripper shaft about a longitudinal axis thereof, a cam segment having a control surface for controlling said swivel device, said control surface being formed by linear generatrices, said cam segment being adjustable so that a gap, formed between said gripper fingers and said gripper pads in the takeover position of the pregripper device and existing until alignment of the sheet at the front lays is terminated, is settable in accordance with the thickness of the sheets, said gap being so defined that said gripper fingers form top lays for a respective leading sheet edge; and a control shaft for carrying said cam segment, said control shaft extending parallel to said generatrices of said control surface and being arranged so as to be adjustable parallel to itself.

2. Sheet transfer device according to claim 1, wherein said control shaft is connected to a roller lever so as to be fixed against rotation relative thereto, and including a roller carried by said roller lever, a cam in engagement with said roller, drive means for rotating said cam, an eccentric bushing rotatably mounted in a side wall of the printing machine and rotatably bearing said control shaft; and adjusting means for turning said eccentric bushing.

3. Sheet transfer device according to claim 2, wherein said eccentric bushing, in a middle position wherein said gap formed between said gripper fingers and said gripper pads in said takeover position is adjusted to a medium sheet thickness, is oriented so that respective longitudinal axes of said control shaft, said eccentric bushing and said roller are disposed substantially in one plane.

4. Sheet transfer device according to claim 2, including means for adjusting said cam in phase position with respect to said drive means for rotating said cam.

* * * * *